US006726142B2

(12) United States Patent
Abba et al.

(10) Patent No.: US 6,726,142 B2
(45) Date of Patent: Apr. 27, 2004

(54) TWIST CONTROLLING DEVICE, ROTATABLE NIP AND AXIAL FEED SYSTEM

(75) Inventors: Rodney L. Abba, Oshkosh, WI (US); Robert J. Waldron, Appleton, WI (US); Robert J. Makolin, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 113 days.

(21) Appl. No.: 10/038,803

(22) Filed: Dec. 31, 2001

(65) Prior Publication Data

US 2003/0122028 A1 Jul. 3, 2003

(51) Int. Cl.[7] ..... B65H 57/18
(52) U.S. Cl. ..... 242/566; 242/615.2
(58) Field of Search ..... 242/564, 593, 242/566, 615.1, 615.2, 615.21, 615.3; 57/82

(56) References Cited

U.S. PATENT DOCUMENTS

| | | | | |
|---|---|---|---|---|
| 940,231 A | * | 11/1909 | Blessing | |
| 1,178,566 A | | 4/1916 | Wright | |
| 1,333,147 A | | 3/1920 | Wright | |
| 1,958,692 A | * | 5/1934 | Besal et al. | 242/615.1 |
| 2,887,281 A | * | 5/1959 | Caufield | 242/566 |
| 3,089,588 A | | 5/1963 | Correll | |
| 3,285,446 A | * | 11/1966 | Strickland | 242/615.2 |
| 3,379,386 A | | 4/1968 | Bobolts et al. | |
| 3,719,330 A | | 3/1973 | Dell Antonio et al. | |
| 3,806,054 A | | 4/1974 | Johnson et al. | |
| 3,810,591 A | | 5/1974 | Haven | |
| 3,889,891 A | * | 6/1975 | Walker | 242/566 |
| 3,934,775 A | * | 1/1976 | Keller | 242/615.1 |
| 4,022,396 A | | 5/1977 | Manchester et al. | |
| 4,597,255 A | * | 7/1986 | Hunter et al. | |
| 4,610,408 A | | 9/1986 | Box et al. | |
| 4,773,610 A | | 9/1988 | Nordlof | |
| 5,174,449 A | | 12/1992 | Ball | |
| 5,301,889 A | | 4/1994 | Ball | |
| 5,310,056 A | | 5/1994 | Ball | |
| 5,456,098 A | | 10/1995 | Hartwig et al. | |
| 5,474,208 A | | 12/1995 | Ball | |
| 5,482,225 A | | 1/1996 | Hartwig et al. | |
| 5,911,386 A | * | 6/1999 | Martin | 242/566 |
| 5,927,051 A | | 7/1999 | O'Connor et al. | |
| 5,966,905 A | | 10/1999 | O'Connor et al. | |
| 5,987,851 A | | 11/1999 | O'Connor | |

FOREIGN PATENT DOCUMENTS

| | | |
|---|---|---|
| JP | 62185659 A | 8/1987 |
| JP | 62185660 A | 8/1987 |
| JP | 63300058 A | 12/1988 |
| JP | 02117713 A | 5/1990 |

* cited by examiner

*Primary Examiner*—William A. Rivera
(74) *Attorney, Agent, or Firm*—Senniger, Powers, Leavitt & Roedel

(57) ABSTRACT

A twist controlling device for ribbon material wound in a coil about a central axis. The device controls twists in the ribbon material as it is fed from the coil to a processing machine. The device includes a gate adapted to be positioned along a ribbon feed path from the coil to the processing machine and having an opening therethrough for receiving the ribbon material. The gate is adapted to engage the ribbon and is rotatable about a gate axis generally coincident with a center of the opening for controlling twisting of the ribbon.

26 Claims, 4 Drawing Sheets

TWIST CONTROLLING DEVICE, ROTATABLE NIP AND AXIAL FEED SYSTEM

BACKGROUND OF THE INVENTION

The present invention relates generally to continuously supplying flexible raw material generally in the form of a web to a processing machine, and more particularly to a stock of ribbon material and methods for controlling twisting of the ribbon material fed to the processing machine.

Conventional processing machines, such as those used to convert narrow ribbons of raw material into finished product, run most efficiently when a continuous feed of raw material is provided. If continuous feed of raw material is not maintained, the machine must be shut down to re-thread the ribbon material. Shutting down the machine negatively impacts the efficiency of the machine, especially machines used in high volume processes such as the production of feminine care products.

Raw absorbent material used to produce feminine care products is initially manufactured as a web of absorbent material measuring one meter or more in width. The processing machine cannot process such a wide web, so the material is trimmed to form many ribbons of a more usable narrow width. The wide web is suitably scored or sheared to form the ribbons. Typically, the ribbons are then wound onto cores to form coils or "pancake slits", so-called due to the fact they resemble pancakes when laid flat. Each coil has a thickness substantially equal to a width of the ribbon material, and each successive revolution or turn of ribbon substantially overlies the preceding revolution so that the coil is no thicker than the ribbon material is wide.

The coils are shipped to a factory where the processing machine is located, and one coil at a time is mounted on a horizontal axis spindle for continuous feed of raw material into the processing machine. The machine pulls the ribbon in a direction tangential to the coil, i.e., parallel to a plane of the coil and perpendicular to an axis of the coil, so that there is no twisting of the ribbon during feeding. The spindle is a variable-speed motorized spindle with sufficient capacity for mounting only one coil of absorbent material. The spindle is variable-speed to keep tension in the ribbon as it is fed into the machine. It will be understood that at a constant linear feed rate, the coil will rotate faster as its supply of ribbon is consumed by the machine. Due to the high cost of each spindle, no more than two spindles are typically provided at the machine. Thus, as a first coil is consumed, a second coil is mounted on the second spindle, and the trailing end of the first coil is spliced to a leading end of the second coil.

An obvious disadvantage of this arrangement is that an operator must be standing by to load coils as they are consumed by the machine. The time period between changing coils (referred to as runout time) will vary with the length of the material on the coil and the speed of use by the processing machine. In the case of a relatively high throughput feminine pad machine, a typical one thousand lineal meter coil of absorbent material will be consumed in three to nine minutes. Due to this relatively short runout time, the processing machine requires constant manpower to maintain continuous feed. Moreover, the short runout time and the difficulty of loading the bulky coil on the spindle increases the likelihood that the splice will fail (e.g., due to operator error or mechanical problems in splicing) and the likelihood that the machine will have to be shutdown for re-threading.

There are other methods of providing continuous feed material to a processing machine. For example a processing machine is shown in U.S. Pat. No. 1,178,566 (Wright) wherein the ribbon material is formed into a stack of coils, and an end of the upper coil is pulled parallel to the axis of the coil into the machine. This arrangement causes the ribbon material to twist as it is unwound. The patent shows a device for removing the twists including a rotatable guide which rotates in response to twists in the ribbon and a powered turntable which intermittently rotates the coils (i.e., rotation starts and stops repeatedly) in response to rotation of the guide.

SUMMARY OF THE INVENTION

Briefly, apparatus of this invention is a twist controlling device for ribbon material wound in a coil about a central axis. The device controls twists in the ribbon material as it is fed from the coil to a processing machine. The device includes a gate adapted to be positioned along a ribbon feed path from the coil to the processing machine and having an opening therethrough for receiving the ribbon material. The gate is adapted to engage the ribbon and is rotatable about a gate axis generally coincident with a center of the opening for controlling twisting of the ribbon.

In another aspect of the invention, a device for receiving and selectively orienting material includes a bearing assembly including an outer ring and an inner ring rotatably mounted inside the outer ring for rotation about a central gate axis. First and second rollers are rotatably mounted inside the inner ring for rotation about roller axes transverse to the gate axis. The rollers are mounted in parallel spaced relation for receiving the material therebetween. The rollers are adapted to engage the material to control the material orientation by rotation of the inner ring.

In yet another aspect, the present invention provides an axial feed system of a processing machine for continuously feeding a coil of ribbon material thereto. The coil has a central axis perpendicular to a plane of the coil. The system includes an intake feed mechanism for pulling the ribbon material into the processing machine. The intake feed mechanism is adapted to pull the ribbon material from the coil in a twist-promoting direction. The intake feed mechanism includes a plurality of gates adapted for controlling twists in unwound ribbon material. Each gate includes an opening therethrough for receiving the ribbon material therethrough and is rotatable about a gate axis generally coincident with a center of the opening for controlling the twists.

Other features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
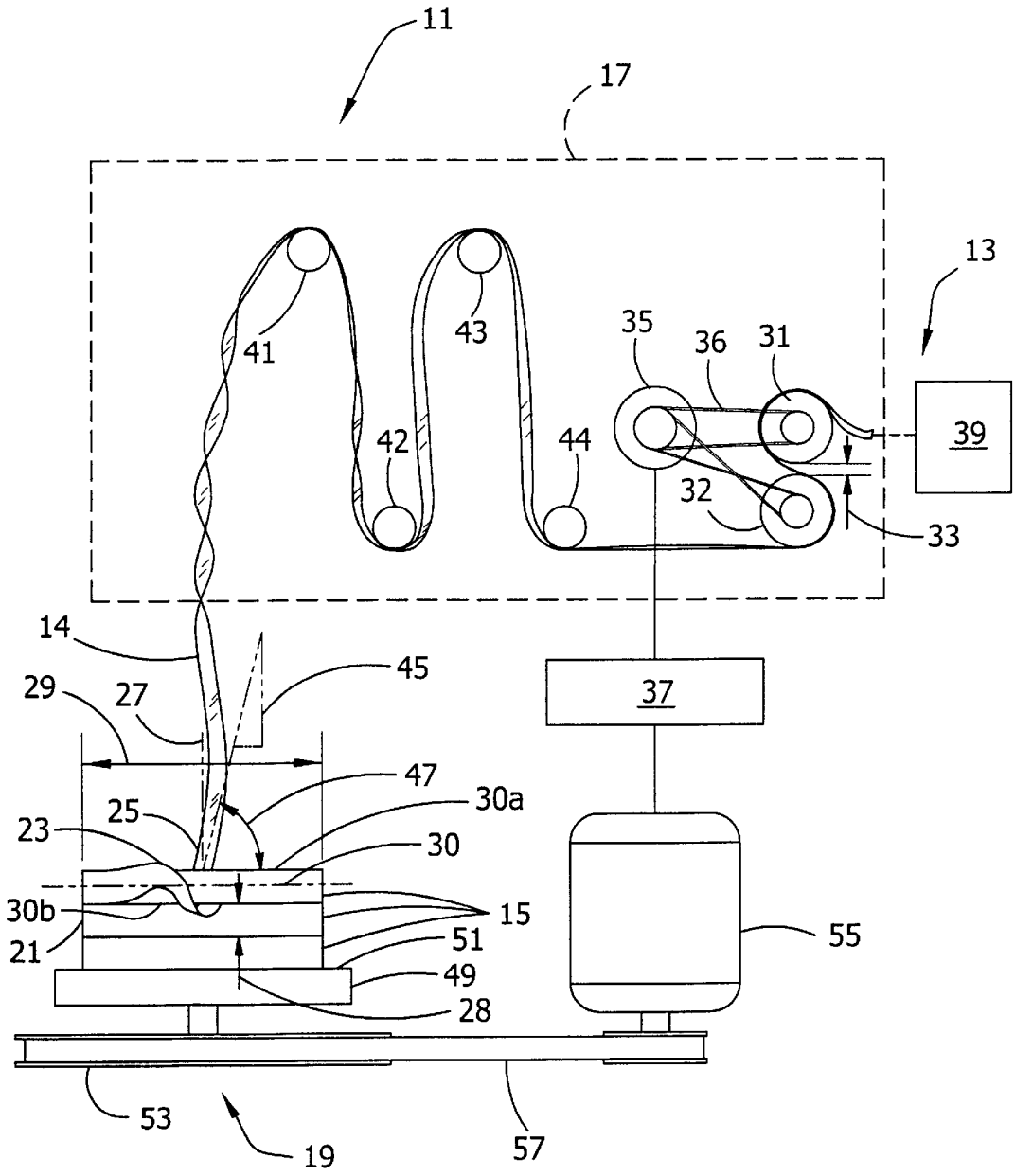
FIG. 1 is a schematic front elevation of an axial feed system of the present invention.

Referring now to the drawings and in particular to FIG. 1, an axial feed system of the present invention is designated in its entirety by the reference numeral 11. The axial feed system forms part of a processing machine generally designated by 13 (only the feed system of the machine is shown in detail). An example processing machine is a feminine pad processing machine manufactured by Keller Technology Corporation of Buffalo, N.Y., though other types of processing machines are contemplated. The axial feed system 11 is desirably adapted to continuously feed ribbon material 14 from a coil 15 to the processing machine 13. Generally, the system 11 includes an intake feed mechanism 17 for pulling the ribbon material 14 into the processing machine and a powered turntable generally designated 19 positioned upstream from the intake feed mechanism for supporting the coil 15.

In the illustrated embodiment, the coil 15 is one of three coils which together form a stock 21 of ribbon material 14. Desirably, the stock 21 of ribbon material 14 includes more than three coils, e.g., 10, 20 or more coils. Although the coils 15 may be joined in other ways without departing from the present invention, in one embodiment an outer end 23 of each coil 15 is suitably spliced to a central end 25 of the adjacent lower coil, e.g., using double-sided adhesive tape or other adhesive, so that the coils are connected together for continuous feed to the machine 13. Each coil 15 is formed of ribbon material 14, such as absorbent raw material used in making feminine care products, wound about a central axis 27 of the coil. The ribbon material 14 is sheared or "slit" from a wide roll (e.g., having a width of one meter or more) of absorbent raw material. Each of the resulting coils of one embodiment has a thickness 28 between about 20 mm and about 50 mm, desirably about 37 mm and a diameter 29 between about one and about two meters, e.g., 1.2 meters. The central axis 27 is generally perpendicular to a plane 30 of the coil which is generally midway between a top 30*a* and bottom 30*b* of the coil. It will be understood that the thickness 28 and diameter 29 of the coil 15 may vary without departing from the scope of the present invention. It is contemplated that the stock 21 may include a continuous supply of ribbon 14, rather than spliced coils 15. In other words, a long, continuous ribbon 14 could be wound to form several coils 15. It is further contemplated that single coils be mounted one at a time on the turntable 19, rather than a stack of coils 15.

Figure 2:
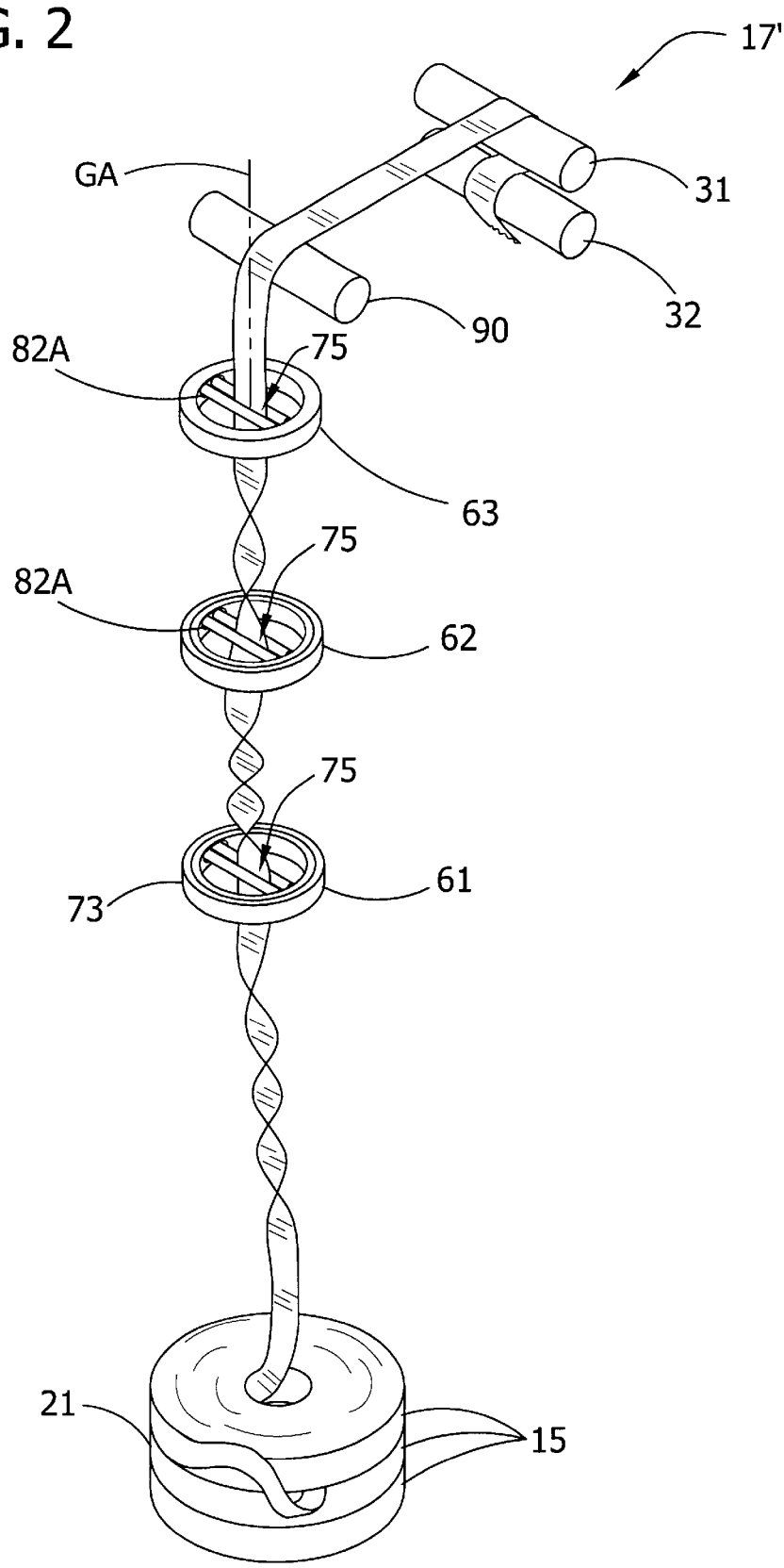
FIG. 2 is a schematic perspective of an axial feed system of a second embodiment of the present invention.

Still referring to FIG. 1, the intake feed mechanism 17 includes driven upper and lower rolls 31, 32, respectively, for pulling the ribbon material 14 from the coils 15 into the machine. The rolls 31, 32 are generally parallel and spaced apart so that there is a gap 33 between the rolls. The ribbon material 14 is threaded around a portion of each roll 31, 32 so that, as viewed in FIG. 1, the ribbon material engages the right portion of the periphery of the lower roll and the opposite or left portion of the periphery of the upper roll. Thus, the ribbon material 14 forms an "S" shape. Note that the roll arrangement of this embodiment is commonly referred to as an "S-wrap". To pull the material 14, the lower roll 32 is turned counterclockwise and the upper roll 31 is turned clockwise, as viewed in FIG. 1. As will be appreciated by those skilled in the art, this arrangement may be changed, e.g., as shown in FIG. 2, without departing from the scope of the present invention. The rolls 31, 32 of the embodiment shown in FIG. 1 are driven by a motor 35 connected to the rolls by a transmission 36 formed from belts and pulleys. A controller 37 is connected to the motor 35 and is adapted to activate the motor to begin feeding ribbon material 14 into the processing machine 13. Together, the rolls 31, 32, motor 35, transmission 36 and controller 37 form a pulling means. Other pulling means known in the industry are contemplated within the scope of the invention, such as a driven nip (not shown but similar to the nips described hereinafter) wherein parallel rollers of the nip grip the material in a space between the rollers, and the rollers are rotated to force the ribbon material through the space. Additional suitable pulling means well known in the industry include "vacuum conveyors" or "vacuum rollers" (not shown). Upon being pulled through the driven rolls 31, 32, the ribbon material 14 may be fed through additional downstream components such as a conventional tensioner (not shown) and may also be pulled by a second pulling means, such as a vacuum roller (not shown). Downstream from the driven rolls 31, 32, the ribbon material 14 is typically cut to a usable length by a cutting mechanism (not shown). These downstream components are schematically represented by element 39 forming a portion of the processing machine 13.

In this embodiment, the intake feed mechanism 17 includes a series of turnbars (e.g., four turnbars 41–44) positioned upstream from the driven rolls 31, 32 and downstream from the coils 15 for controlling twists in the ribbon material 14 unwound from the coils. Each turnbar 41–44 is a cylinder fixed to structure (not shown) of the processing machine 13, or to structure adjacent the machine. Additionally, one or more of the turnbars 41–44 may be rotatably mounted, rather than fixed, on the structure to reduce drag on the ribbon material 14 so it is less likely to break. The ribbon material 14 is threaded through the turnbars 41–44 to isolate the processing machine from twists in the unwound ribbon material. The turnbars 41–44 serve to change the ribbon material feed direction and to inhibit the twists from proceeding further downstream. Generally, the turnbars 41–44 are suitably shaped and arranged so that twists in the ribbon material 14 do not pass the last turnbar and are thus isolated from the driven rolls 31, 32. In one embodiment, the turnbars 41–44 are arranged so that the first turnbar 41 and third turnbar 43 form an upper row of turnbars, the second turnbar 42 and fourth turnbar 44 form a lower row of turnbars, and the feed direction changes about 180° at each of the first three turnbars 41–43 and changes about 90° at the fourth turnbar. A desirable turnbar arrangement will vary depending on the characteristics of the ribbon material 14 (e.g., its stiffness and strength) and the feed rate, among other factors. Note that the feed mechanism 17 may include other twist controlling devices (e.g., nips or gates, described below) in combination with or instead of the turnbars 41–44.

The intake feed mechanism 17 is an axial feed mechanism adapted to pull the ribbon material 14 from the coils 15 at an angle 47 having an axial component 45 extending parallel to, or coincident with, the axis 27 of the coil (generally, a twist-promoting direction). In other words, the material 14 is pulled at the angle 47 to the plane 30 of the coil 15 so that twisting of the unwound ribbon material is likely to occur. The angle 47 may be nearly perpendicular to the plane 30. A minimum pulling angle (not shown) which promotes or causes twisting will vary according to the characteristics of ribbon material 14, the feed rate and other factors, and the minimum angle may range from as little as 1° to as much as 30°, 40° or 50° degrees. Referring again to FIG. 1, in one embodiment the ribbon material 14 is threaded over the turnbars 41–44, and is pulled in the direction of the first turnbar 41 of the feed mechanism 17. The first turnbar 41 is positioned generally above the coils 15. The ribbon material 14 is pulled from the coils 15 at the angle 47 relative to the plane 30 of the coil 15 and, therefore, the unwound material twists. Note that the ribbon material 14 is pulled beginning at the center end 25 of the coil 15, but may also be pulled beginning at the outer end 23 of the coil.

The powered turntable 19 includes a generally circular platform 49 having a generally horizontal support surface 51. The powered turntable 19 further includes a pulley 53 attached to the platform 49 and a motor 55 connected to the pulley by a drive belt 57 for rotating the turntable. In one embodiment, the motor 55 is adapted to rotate the coils 15 continuously at a substantially constant rotational speed, and is not adapted to rotate the coils at intervals or at a variable rotational speed while the ribbon 14 is being fed into the machine 13. During unwinding, the coils 15 are continuously rotated generally about the central axis 27 of the coils at a rotational speed selected to maintain a number of twists in the unwound ribbon material 14 below a predetermined number. Desirably, the predetermined number of twists in the unwound ribbon material 14 is sufficiently low that the ribbon material is substantially untwisted along at least some portion of the intake feed mechanism 17. Accordingly, the rotational speed is selected such that the number of twists in the unwound ribbon material 14 is maintained sufficiently low that the ribbon material is substantially untwisted when passing through a downstream portion of the intake feed mechanism 17. In this embodiment, the ribbon material 14 is untwisted when it is received by the driven rolls 31, 32, and desirably is untwisted upstream from the driven rolls, e.g., at the fourth turnbar 44 or the third turnbar 43. The predetermined number of twists in the unwound material 14 will vary depending upon, among other factors, distance between the coil 15 and the intake feed mechanism 17, the characteristics of the ribbon material, and the number and configuration of twist controlling devices, such as the turnbars 41–44, of the intake feed mechanism. The rotational speed in revolutions per minute (generally, per unit time) is desirably less than a number of revolutions of ribbon material 14 unwound adjacent the center of the coil 15 during one minute and greater than a number of revolutions of ribbon material unwound adjacent the outer periphery of the coil during one minute. As will be understood by those skilled in the art, for a constant linear feed rate, the number of turns pulled from the coil 15 decreases from the center of the coil to its periphery. In one embodiment, a suitable range of rotational speed is between about 700 and about 1100 revolutions per minute for a feed rate of about 1000 feet per minute. Although the rotational speed may be determined in revolutions per minute as described above, those skilled in the art will appreciate that the rotational speed may be determined using other units of time (e.g., revolutions per second) without departing from the scope of the present invention. Because the intake feed mechanism 17 pulls the ribbon material 14 at a substantially constant rate, and turntable speed is constant, the number of twists in the unwound ribbon varies as each coil 15 is consumed.

During operation of the machine 13, the controller 37 causes the driven rolls 31, 32 to rotate and thereby pull ribbon material 14. Simultaneously, or shortly thereafter, rotation of the powered turntable 19 is initiated. Rotation of the turntable 19 is continuous during rotation of the driven rolls 31, 32 until the stock 21 is consumed.

Figure 3:
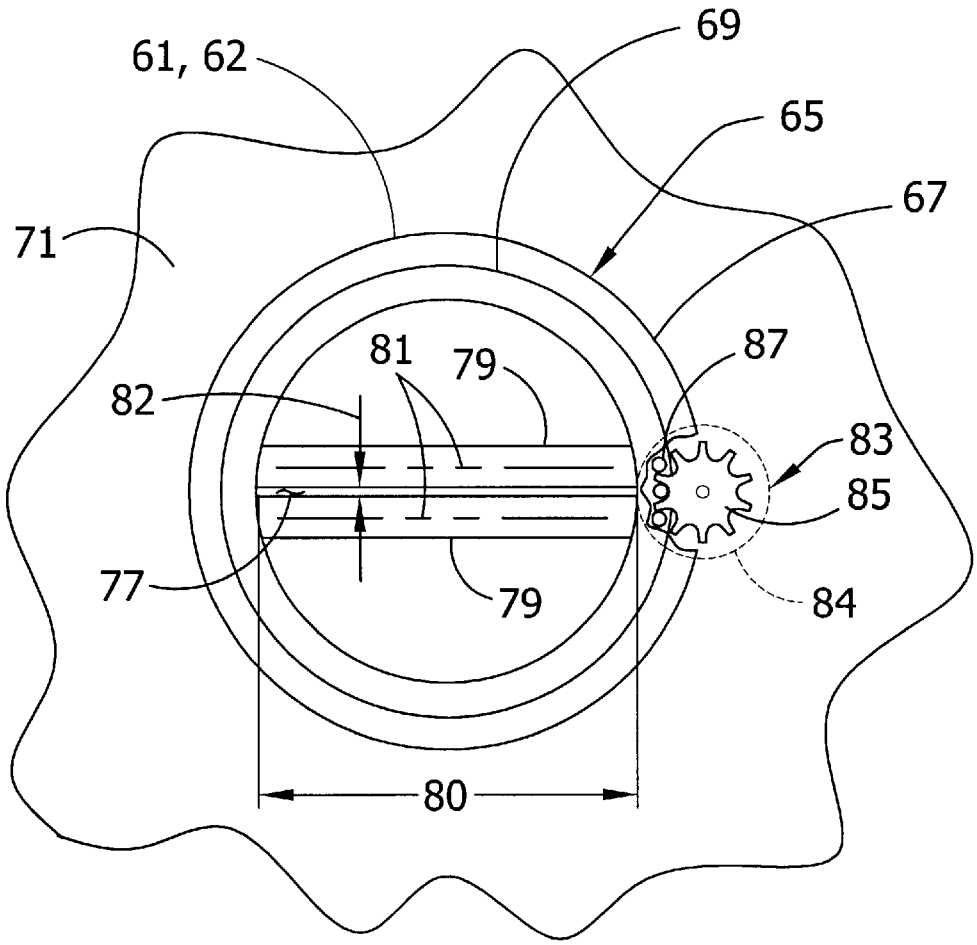
FIG. 3 is a schematic top plan of a gate device of the second embodiment adapted for rotation about a gate axis.
Figure 4:
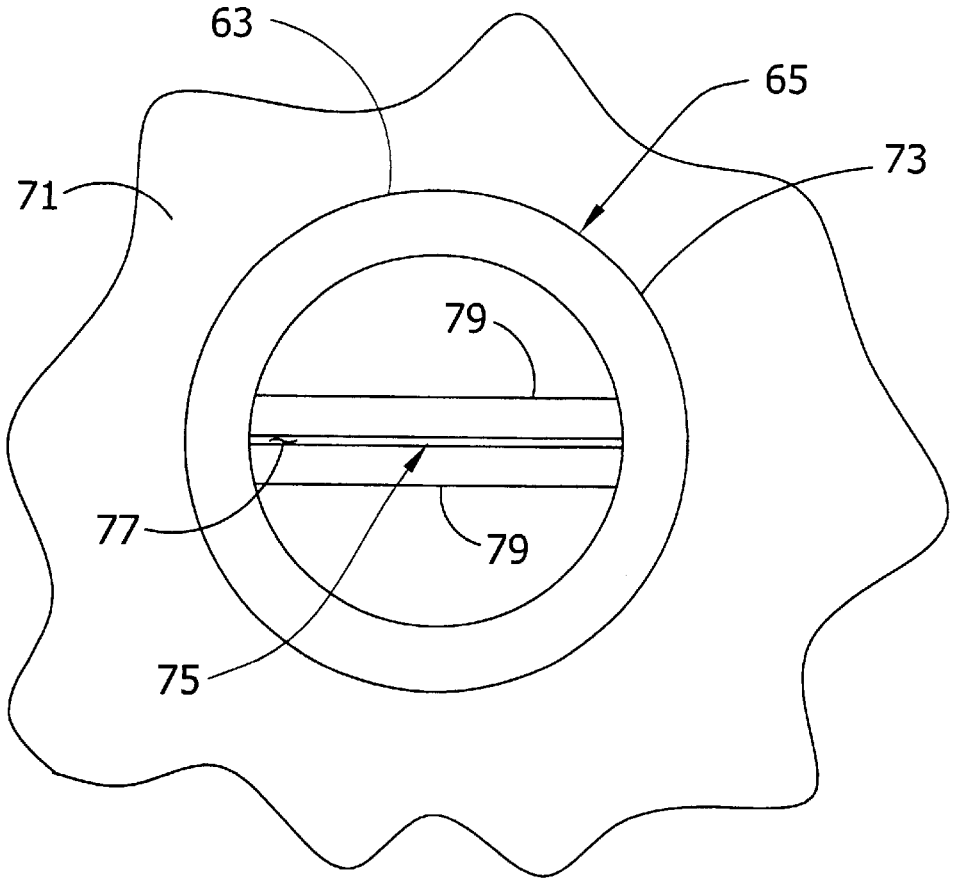
FIG. 4 is a schematic side elevation of another gate device of the second embodiment fixed from rotation about the gate axis.

Referring to FIGS. 2–4, in a second embodiment the intake feed mechanism 17' includes an upstream or first nip 61 (generally, twist control device or material orienting device), an intermediate or second nip 62 and a downstream or third nip 63 (generally, twist controlling devices) positioned upstream from the driven rolls 31, 32 so that there are substantially no twists in the ribbon material 14 received by the driven rolls. Each nip 61–63 provides a gate, generally designated 75, having an opening 77 therethrough for receiving the ribbon material 14. The gates 75 provided by the first and second nips 61, 62 are rotatable about a gate axis GA generally coincident with a center of the respective opening 77. However, the gate 75 provided by the third nip 63 is fixed from rotation about its gate axis GA. In one embodiment, each gate 75 includes at least two parallel rollers 79 mounted for rotation about respective parallel roller axes 81 which extend transverse to the gate axis GA.

As illustrated in FIG. 3, the first and second nips 61, 62 include a bearing assembly generally designated by 65 having an outer ring 67 and an inner ring 69 rotatably mounted inside the outer ring. The bearing assembly 65 is suitably a conventional bearing having ball bearings (not shown) mounted in a raceway (not shown) between the inner and outer rings 69, 67, respectively. Each outer ring 67 is fixed to structure 71 of the processing machine. The rollers 79 of the first and second nips are rotatably mounted on the inner ring 69. Thus, the rollers 79 are rotatable together within the inner ring 69 about the gate axis GA and independently about their respective roller axes 81.

Referring to FIG. 4, the third nip 63 includes a support member 73 fixed to the structure 71. Although the illustrated support member 73 is ring-shaped, those skilled in the art will appreciate the support member may have other shapes without departing from the scope of the present invention. The gate 75 provided by the third nip 63 is not rotatable about its gate axis GA (FIG. 2). The rollers 79 of the fixed third nip 63 are mounted on the support member 73 for rotation about the roller axes 81 (axes are shown in FIG. 3) but do not rotate about the gate axis GA.

The rollers 79 at least partially define a height 82 of the opening 77. A width 80 of the opening 77 is defined by an inner diameter of the inner ring 69. In one embodiment, the rollers 79 may be mounted so as to be movable relative to one another so that the space between the rollers is adjustable to vary the height 82 of the opening. Such mounting may be accomplished by mounting the rollers 79 in slots 82*a* (FIG. 2) formed in the inner ring 69 and the ring-shaped member 73 and holding the rollers in position, for example, by a conventional spring tension mechanism within the rollers (not shown). The rollers 79 may also be fixed to the inner ring 69 and support member 73, as by welding. In one embodiment, the height 82 (FIG. 3) of the opening 77 is generally equal to a thickness of the ribbon material 14, but may also be less than or greater than the thickness of the ribbon material. It is contemplated that stationary turnbars be used instead of rollers 79.

Referring to FIG. 3, the rotatable nips 61, 62 may include an actuator, generally designated 83, operatively connected to the inner ring 69 of each nip for rotating the respective nip. The actuator 83 of one embodiment is a motor 84 which rotates a gear 85 positioned to engage pins 87 fixed to the inner ring 69 of the respective bearing assembly 65. Other actuators are contemplated. The controller 37 (FIG. 1) is operatively connected to the motor 84 of each actuator 83 and activates one or both motors to reduce the number of twists in the ribbon material 14 adjacent the nips 61, 62. The intake feed mechanism 17 may also include conventional sensors (not shown) electrically connected to the controller 37 for sensing the number of twists in the ribbon material 14 adjacent each gate 75. The controller 37 may be programmed to cause rotation of the nip at predetermined time intervals, or when there is a predetermined number of twists (e.g., 5 twists) adjacent the nip.

Referring to FIG. 2, in one embodiment the unwound ribbon material 14 extends through the nips 61–63, over a turnbar 90 and is pulled by driven rolls 31, 32. The gate axis GA of each gate 75 is generally parallel or coincident with the axis 27 of the coils 15 such that ribbon material 14 is pulled in a twist-promoting direction. As the ribbon material 14 is pulled through the nips 61–63, twists, e.g., clockwise twists, form in the unwound ribbon material upstream from the first nip 61. When a predetermined number of twists are formed, the first nip 61 will rotate, e.g., 180° in a clockwise direction, and thereby remove one 180° twist upstream from the nip but cause one 180° twist to be formed downstream from the nip (between the first and second nips 61, 62). Rotation may be caused either by the torsional force of the twists in the ribbon material 14, or by the actuator 83 in response to a signal from the controller 37. Likewise, after a sufficient number of twists is formed between the first and second nips 61, 62, the second nip will rotate to form a twist in the material 14 between the second nip and the third nip 63. After a period of time, the twists upstream from the first nip 61 may begin to form in a counterclockwise or opposite direction (e.g., when the nips 61–63 are used with the turntable 19), and, therefore, the nips will begin to rotate in the opposite direction. Desirably, the third nip 63 does not rotate about its gate axis GA so that twists are unlikely to pass therethrough. Therefore, the ribbon material 14 is substantially untwisted (or flat) when it is received by the driven rolls 31, 32.

The nips 61–63 of the second embodiment may be advantageously used in combination with the turnbars 41–44 and/or with the coils 15 mounted on the turntable 19 as described in the first embodiment. The nips 61–63 may also be used in combination with coils as described in our co-pending applications filed simultaneously herewith, both of which are entitled METHOD FOR AXIAL FEEDING OF RIBBON MATERIAL AND A STOCK OF RIBBON MATERIAL COILS FOR AXIAL FEEDING and which are incorporated herein by reference. In the co-pending applications, some coils in a stack of coils reverse the unwind direction of the preceding coil. Use of such a stack of coils, without use of the turntable 19 of the first embodiment, may likewise prove advantageous in that the twists which are formed between the nips will be removed due to the reversal of the twisting direction.

The invention provides a relatively inexpensive method and apparatus for controlling or reducing twisting in "axially fed" ribbon material 14. The powered turntable 19 is less expensive than those shown in the prior art in that is powered by a one-speed motor which turns at a constant speed. The nips 61–63 provide a relatively simple and inexpensive apparatus for preventing twists from entering portions of the machine 13 wherein twisting of the ribbon material would cause problems or stoppages in feeding. The nips 61–63 need not be powered or controlled, though such mechanisms could be included as described herein.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A twist controlling device for ribbon material wound in a coil about a central axis, said device controlling twists in the ribbon material as it is fed from said coil to a processing machine, the device comprising:

a plurality of gates, each gate being adapted to be positioned along a ribbon feed path from the coil to the processing machine and including an opening therethrough for receiving the ribbon material, each gate adapted to engage the ribbon and at least one gate of said plurality of gates being rotatable about a gate axis generally coincident with a center of the opening for controlling twisting of the ribbon.

2. A device as set forth in claim 1 wherein said opening has a height and a width, said width of the opening being greater than a width of the ribbon material.

3. A device as set forth in claim 1 wherein the at least one gate includes at least two parallel, rotatable rollers at least partially defining a height of the opening.

4. A device as set forth in claim 3 further comprising a bearing assembly including an outer ring and an inner ring rotatably mounted inside the outer ring, wherein said rollers are rotatably mounted on said inner ring.

5. A device as set forth in claim 4 wherein the height of the opening is generally equal to a thickness of the ribbon material.

6. A device as set forth in claim 1 further comprising an actuator for rotating the at least one gate.

7. A device as set forth in claim 6 wherein the actuator comprises a motor and the device further comprises a controller for controlling the motor.

8. A device as set forth in claim 1 further comprising a bearing assembly including an outer ring and an inner ring rotatably mounted inside the outer ring, wherein said at least one gate is mounted on the inner ring.

9. A device as set forth in claim 1 wherein one of said gates is an upstream gate and another of said gates is a downstream gate positioned downstream from said upstream gate for receiving the ribbon material from said upstream gate.

10. A device as set forth in claim 9 wherein said downstream gate includes an opening therethrough for receiving the ribbon material.

11. A device as set forth in claim 10 wherein said downstream gate is fixed from rotation about a downstream gate axis generally coincident with a center of the downstream gate opening.

12. A device for receiving and selectively orienting material comprising:

a bearing assembly including an outer ring and an inner ring rotatably mounted inside the outer ring for rotation about a central gate axis, and first and second rollers rotatably mounted inside the inner ring for rotation about roller axes transverse to the gate axis, said rollers being mounted in parallel spaced relation for receiving said material therebetween, the rollers being adapted to engage the material to control the material orientation by rotation of the inner ring;

the device being free of any motor in driving relationship with the bearing assembly, the bearing assembly being adapted for rotation of the inner ring upon build up of torsional force in the material caused by twists in the material.

13. An axial feed system of a processing machine for continuously feeding a coil of ribbon material thereto, the coil having a central axis perpendicular to a plane of the coil, the system comprising:

an intake feed mechanism for pulling the ribbon material into the processing machine, the intake feed mechanism being adapted to pull the ribbon material from the coil in a twist-promoting direction, the intake feed mechanism including a plurality of gates adapted for controlling twists in unwound ribbon material, each gate including an opening therethrough for receiving the ribbon material and being rotatable about a gate axis generally coincident with a center of the opening for controlling the twists.

14. A system as set forth in claim 13 wherein said opening has a height and a width, said width of the opening being greater than a width of the ribbon material.

15. A system as set forth in claim 14 wherein the gate includes at least two parallel, rotatable rollers at least partially defining the height of the opening.

16. A system as set forth in claim 15 further comprising a bearing assembly including an outer ring and an inner ring rotatably mounted inside the outer ring for rotation about the gate axis, wherein said rollers are rotatably mounted on said inner ring for rotation about roller axes extending transverse to the gate axis.

17. A system as set forth in claim 14 wherein the height of the opening is generally equal to a thickness of the ribbon material.

18. A system as set forth in claim 13 further comprising an actuator for rotating the gate.

19. A system as set forth in claim 18 wherein the actuator comprises a motor and the device further comprises a controller for controlling the motor.

20. A system as set forth in claim 13 further comprising a bearing assembly including an outer ring and an inner ring rotatably mounted inside the outer ring, wherein said gate is mounted on the inner ring.

21. A system as set forth in claim 13 wherein one of said gates is an upstream gate and said device further comprises a downstream gate positioned downstream from said upstream gate for receiving the ribbon material from said upstream gate.

22. A system as set forth in claim 21 wherein said downstream gate includes an opening therethrough for receiving the ribbon material.

23. A system as set forth in claim 22 wherein said downstream gate is fixed from rotation about a downstream gate axis generally coincident with a center of the downstream gate opening.

24. A system as set forth in claim 13 in combination with the processing machine.

25. A twist controlling device for ribbon material wound in a coil about a central axis, said device controlling twists in the ribbon material as it is fed from said coil to a processing machine, the device comprising:

an upstream gate and a downstream gate each being adapted to be positioned along a ribbon feed path from the coil to the processing machine and including an opening therethrough for receiving the ribbon material, each gate adapted to engage the ribbon and said upstream gate being rotatable about a gate axis generally coincident with a center of the opening for controlling twisting of the ribbon, said downstream gate being positioned downstream from said upstream gate for receiving the ribbon material from said upstream gate, said downstream gate having an opening therethrough for receiving the ribbon material and fixed from rotation about a downstream gate axis generally coincident with a center of the downstream gate opening.

26. An axial feed system of a processing machine for continuously feeding a coil of ribbon material thereto, the coil having a central axis perpendicular to a plane of the coil, the system comprising:

an intake feed mechanism for pulling the ribbon material into the processing machine, the intake feed mechanism being adapted to pull the ribbon material from the coil in a twist-promoting direction, the intake feed mechanism including a plurality of gates adapted for controlling twists in unwound ribbon material, each gate including an opening therethrough for receiving the ribbon material and being rotatable about a gate axis generally coincident with a center of the opening for controlling the twists, one of said gates being an upstream gate, and a downstream gate positioned downstream from said upstream gate for receiving the ribbon material from said upstream gate, said downstream gate having an opening therethrough for receiving the ribbon material and fixed from rotation about a downstream gate axis generally coincident with a center of the downstream gate opening.

* * * * *